United States Patent [19]

Thurston et al.

[11] Patent Number: 4,483,250

[45] Date of Patent: Nov. 20, 1984

[54] FLARE MANUAL SAFETY DEVICE

[75] Inventors: James R. Thurston; George A. Berkley, both of Brigham City, Utah

[73] Assignee: Thiokol Corporation, Chicago, Ill.

[21] Appl. No.: 485,083

[22] Filed: Apr. 14, 1983

[51] Int. Cl.[3] ..... F02K 5/04; F42C 15/00

[52] U.S. Cl. ..... 102/254; 102/260; 60/39.091

[58] Field of Search ..... 102/254, 256, 258, 260, 102/261, 270, 221, 222; 60/39.091, 39.821, 39.823

[56] References Cited

U.S. PATENT DOCUMENTS

| | | | |
|---|---|---|---|
| 2,201,209 | 5/1940 | Schultze | 102/254 |
| 2,392,884 | 1/1946 | Semple | 102/235 X |
| 3,034,435 | 5/1962 | Schermuly | 102/258 |
| 3,423,931 | 1/1969 | Schwarz et al. | 102/222 X |
| 3,529,418 | 9/1970 | Puckett et al. | 102/254 X |
| 3,736,877 | 6/1973 | Roberts et al. | 102/261 X |
| 3,763,785 | 10/1973 | Briggs et al. | 102/256 |

FOREIGN PATENT DOCUMENTS

| | | | |
|---|---|---|---|
| 88318 | 1/1958 | Netherlands | 102/254 |
| 366475 | 2/1963 | Switzerland | 102/206 |

*Primary Examiner*—David H. Brown
*Attorney, Agent, or Firm*—Gerald K. White

[57] ABSTRACT

A manually rotatable cylindrical valve member forms a physical barrier in a "safe" position between a firing pin-primer charge and pyrotechnic flare ignition material. The valving member has a passage through it that, in the "armed" position, is in alignment with the firing pin-primer charge and the flare ignition material. An axial force on the valving member along with a rotational force is required for adjustment between the safe and armed positions and vice versa. Gas venting of the primer, upon accidental or inadvertent firing of the primer, prevents flare ignition when the valving member is in the safe position.

5 Claims, 4 Drawing Figures

FLARE MANUAL SAFETY DEVICE

BACKGROUND OF THE INVENTION

1. Field of the Invention

This invention relates to a manually operated safety device having utility in a system for igniting a pyrotechnic device such as a flare launched from an aircraft and suspended by a parachute.

2. Description of the Prior Art

Many pyrotechnic devices such as military flares and rockets utilize the pulling of a lanyard to release a firing pin to effect ignition or to perform other functions that must be executed after the pyrotechnic device clears a launcher or other hardware. A safety hazard exists with pyrotechnic devices of this type in that if a flare, for example, is dropped during handling or the lanyard inadvertently is caused to be pulled and the primer to be fired, a very serious accident can result.

In the prior art a number of proposals have been advanced for solving this problem. The patents discussed below are a representative sample of a number of these proposals.

An ignition system for air dropped illuminating flares triggered by the parachute shock pull on the ignition lanyard is disclosed in U.S. Pat. No. 3,736,877 granted on June 5, 1973. The ignition propellant is housed in plastic foam for protection and for absorbing the impact shock if the flare should inadvertently be dropped.

A SAFE-ARM device for solid propellant rocket motors is disclosed in U.S. Pat. No. 3,529,418 granted Sept. 22, 1970. In this device there is provided a manually movable plug that in one position precludes accidental or inadvertent ignition of the motor, and in another position permits ignition of the motor on command. When in the safe position, the plug disperses to the atmosphere any gases or flame that result from accidental or inadvertent ignition, with spring tension means maintaining the plug in the safe position.

A similar SAFE-ARM device for solid propellant rocket motors is disclosed in U.S. Pat. No. 3,423,931 wherein the movable plug comprises a double ended piston that is movable in a tubular body and functions as a seal at either end of the body, with the toggle action of a spring maintaining the piston in the safe position.

U.S. Pat. No. 2,392,884 granted Jan. 15, 1946 discloses a fuze for projectiles having safe and arm positions. There is included within the fuze body an unbalanced cylindrical detonator block which normally is held in a fixed safe position by a shear pin. Upon firing of the projectile, setback shears the shear pin and centrifugal force resulting from projectile rotation turns the unbalanced block to the armed position. In the armed position, a passage in the block allows flame and hot gas resulting from the impact of a firing pin and primer to communicate with a booster charge and thereby transmit detonation to a burster charge that fills the main body of the projectile. In the safe position, such communication is precluded by the unbalanced block.

While the foregoing prior art patents recognize some of the desirable attributes of a flare manual safety device, there remain problems with respect to locking the device in the safe position and maintaining it in that position in the event the primer is accidentally or inadvertently fired during handling, and with respect to preventing the gases, in such event, from venting to the outside of the flare. There remain problems also with respect to preventing inadvertent arming or safing of the flare due to shock or vibration and in sealing the flare against moisture and other undesirable foreign matter.

SUMMARY OF THE INVENTION

An object of the invention is to provide an improved flare manual safety device wherein firing of the primer in the safe position by heat, shock, or impact will not propagate to other ignition materials, nor will resultant flame and gases be vented outside of the flare.

Another object of the invention is to provide such a device that is operative in the safe position to provide a physical barrier or interrupter in the ignition train in the event the primer is accidentally or inadvertently fired during handling, such barrier comprising a cylindrical valve member or rotor assembly that may be readily moved from the safe to the arm condition and vice versa by a simple screw driver adjustment.

A further object of the invention is to provide such a device wherein an axial force on the rotor along with a rotational force thereon is required to change the condition of the device, thereby preventing inadvertent arming or safing due to shock or vibration.

In accomplishing these and other objectives of the invention there is provided a rotatable cylindrical valve or rotor assembly that in one position, a safe position, forms a barrier between a pin-primer charge and the pyrotechnic material for flares. There is a passage in the rotor that may be aligned with the firing pin-primer charge and the pyrotechnic material in the armed position thereof. If the primer is accidentally or inadvertently fired by the firing pin, or by some other means, while the safety device is in the safe position, the gases from the primer vent into a slot in the rotor and then through holes in the housing of the safety device back into a relatively large void area around the firing pin. O-ring seals prevent gases from venting to the outside of the flare and also seal the inside of the flare against moisture and other undesirable foreign matter.

The flare manual safety device of the present invention includes a visual indicator which shows whether the device is in the "SAFE" or the "ARM" position. A screw driver slot and associated roll pin both point to either the "SAFE" or the "ARM" designations on the housing of the device to indicate the adjusted condition of the device.

The rotor of the safety device is symmetrical about the center line or axis of rotation thereof and is provided with a screw driver slot so that it can be rotated clockwise or counterclockwise 90° by a screw driver from the "SAFE" position to the "ARM" position or vice versa. The roll pin also acts as a locking device to prevent any rotation of the rotor until the rotor has been depressed against the opposing action of a compession spring sufficiently to allow the roll pin to clear orienting slots in the housing of the device. After being rotated to the desired location and removal of the screw driver, the compression spring forces the rotor and roll pin back into the orienting slots in the housing. In an "ARM" position, a passage in the rotor lines up with the primer and a hole in the housing which lines up with a main charge comprised of boron potassium nitrate pellets. In this position, gases from the primer are channeled directly to the pellets causing them to ignite. The hot gases created by the pellets pass through a perforated plate and ignite the flare solid propellant grain.

BRIEF DESCRIPTION OF THE DRAWING

Having summarized the invention, a detailed description follows with reference being made to the accompanying drawings which form part of the specification, of which.

DESCRIPTION OF THE PREFERRED EMBODIMENT

Figure 1:
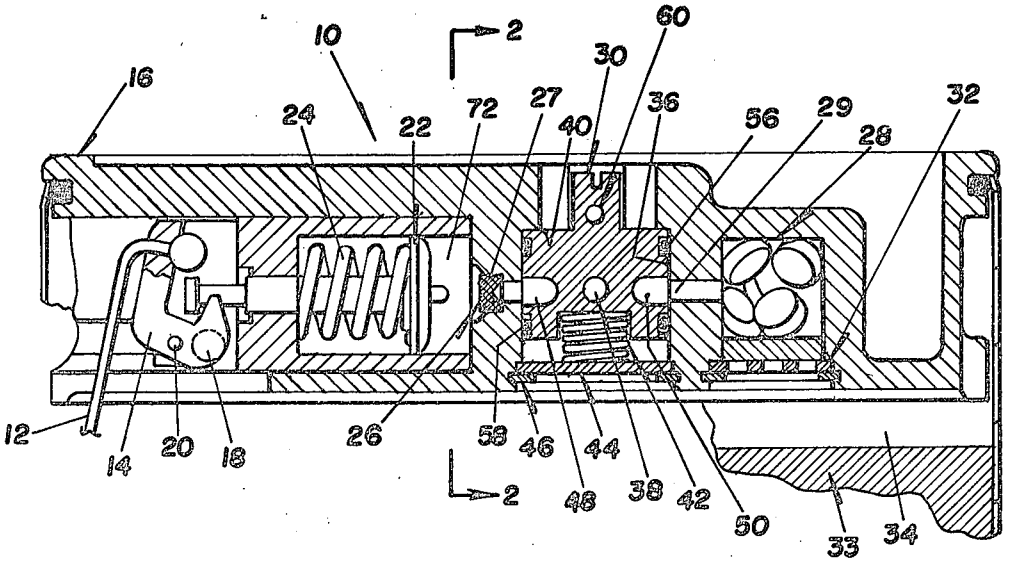
FIG. 1 is a fragmented cross sectional view of the manual safety device of the present invention showing the rotor assembly in the "SAFE" position.

Referring to FIG. 1 of the drawings, the flare manual safety device, indicated generally by reference numeral 10, includes a lanyard 12 having one end fixedly attached by means (not shown) to a parachute cable (also not shown). The other end of the lanyard is attached to a bell crank 14 which is arranged in the flare safety device or igniter housing 16 to rotate about a pivot pin 18 when the lanyard if pulled, usually with a jerk as upon opening of the parachute. A shear pin 20 prevents the bell crank 14 from being rotated until sufficient force is exerted on the lanyard.

The flare manual safety device 10 further includes within housing 16 a firing pin 22, a compression spring 24, a primer 26, highly flammable pellets 28, and a rotor 30. The arrangement is such that upon counter clockwise rotation, bell crank 14 engages the left end of firing pin 22, as seen in the drawing, and pulls the firing pin 22 to the left against the opposing force of compression spring 24. Continued rotation of the bell crank 14 in the counter clockwise direction by the pulling action of the lanyard 12 causes the firing pin 22 to become disengaged from the bell crank 14. Upon such disengagement, the compression spring 24 forces the firing pin 22 to the right against the primer 26 which, by way of example, may comprise a large rifle primer positioned in one end of a hole 27 in housing 16. In an adjacent area within housing 16 to the right of primer 26 but physically separated therefrom by rotor 30 and positioned at the end of a hole 29 in housing 16 are pellets 28 of boron potassium nitrate. Pellets 28 are disposed in cooperative igniting relation with flare grain 33, being separated therefrom by a perforated plate 32 and a large void space 34 between the igniter housing 16 and the flare grain 33. Rotor 30 is positioned for rotation in a bore 36 in housing 16 and includes a diametrically positioned hole 38 that in "ARM" positions of the rotor 30 line up with the straight line path between the primer 26 and the pellets 28 whereby the pellets 28 may be ignited by the heat and flame output of the primer 26. In the "SAFE" position of the rotor 30, the hole 38 is displaced 90° with respect to the path between the primer 26 and pellets 28 in consequence of which the rotor acts as a physical barrier or interrupter between the primer 26 and the pellets 28.

Figure 4:
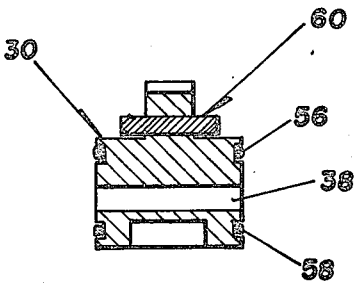
FIG. 4 is a cross sectional view of the rotor assembly of FIG. 1 with the rotor rotated 90° to the "ARM" position.
Figure 2:
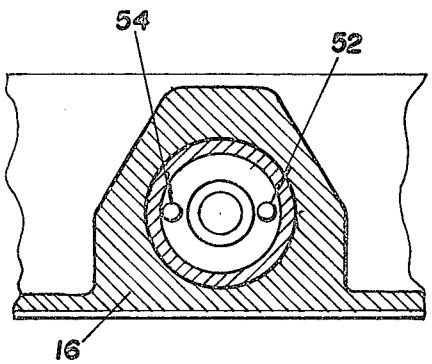
FIG. 2 is a sectional view taken along the lines 2—2 of FIG. 1.
Figure 3:
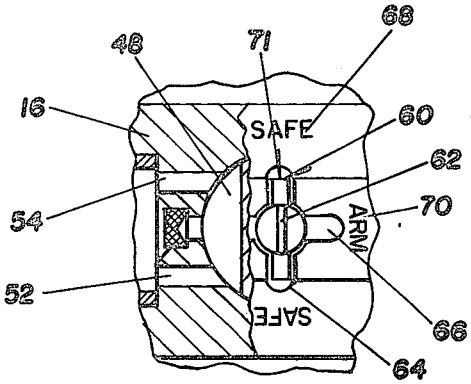
FIG. 3 is a fragmented top plan view, partly in section, of the device of FIG. 1 showing the "SAFE" and "ARM" designations, the screw driver slot, and the cooperating locking roll pin.

As shown in the drawings, rotor 30 is shiftable axially within bore 36 in housing 16 but is normally retained against a shoulder 40 by a compression spring 42, a retaining disc 44, and a retaining ring 46. In addition to hole 38, rotor 30 further includes diametrically displaced chordal slots 48 and 50. Provided in cooperative relation with rotor 30 when the latter is in the safe position are holes 52 and 54 in the structure of housing 16, as seen in FIGS. 2 and 3. Rotor 30 further includes an upper encircling O-ring 56 and a lower encircling O-ring 58, as seen in FIG. 4. Further, as best seen in FIG. 3, there is provided in cooperative relation with rotor 30 and a roll pin 60 which is in alignment with a screw driver slot 62 in the associated end of rotor 30 and which is normally retained in one or the other of two orienting slots 64 and 66 that are positioned at a right angle to each other in housing 16.

The flare manual safety device 10 has visual indicators 68 and 70 on the igniter housing 16 which indicate if the device 10 is in the "SAFE" or the "ARM" position, respectively. The screw driver slot 62 in the rotor 30 and the roll pin 60 both point to either the "SAFE" or the "ARM" designations on the flare safety device housing 16 to indicate the condition. A standard straight screw driver is all that is needed to rotate the rotor 30 from one position to another. The rotor 30 is symmetrical about its center line 71, as seen in FIG. 3, so that it can be rotated clockwise or counter clockwise 90° to go from the "SAFE" position 64 to the "ARM" position 66 or vice versa.

The roll pin 60 acts as a locking device to prevent any rotation of rotor 30 until the rotor 30 has also been depressed by pushing down with the screw driver. After the rotor 30 has been depressed, compressing the compression spring 42 until it bottoms out on the retaining disc 44, the roll pin 60 will have cleared the orienting slots 64 and 66 in the housing 16 and the rotor 30 can be rotated to another position. After the rotor 30 has been rotated to the desired location and the screw driver has been removed, the compression spring 42 forces the rotor 30 and the roll pin 60 back into the orienting slots 64 or 66 in the igniter housing.

MODE OF OPERATION

In the "ARM" position of rotor 30, hole 38 lines up with the primer 26 and the hole 29 which leads to the pellets 28. In this position the gases from the primer 26 are channeled directly to the pellets 28 causing them to ignite. The hot gases created by the pellets 28 pass through the perforated plate 32 and ignite the flare grain 33.

In the "SAFE" position of rotor 30, if the primer 26 is inadvertently fired by the firing pin 22, or by some other means such as heat or shock, for example, the gases from the primer 26 vent into the slot 48 or 50, in the rotor 30 and then through the holes 52 and 54 in housing 16 back into a relatively large void area indicated at 72 around the firing pin 22. The O-ring 56 prevents the gases from venting to the outside of the flare safety device 10 and also seals the inside of the device 10 against moisture and other undesirable foreign matter. O-ring 58 prevents the gases from venting past the compression spring 42, retaining disc 44 and retaining ring 46 into the large void area 34 between the igniter housing 16 and the flare grain 33. While some gases may vent between the igniter housing 16 and the rotor 30 and into the hole 29 which leads to the pellets 28, the quantity of gas is too small and too low in temperature to cause the pellets 28 to ignite.

Thus, in accordance with the invention there has been provided a flare manual safety device wherein firing of the primer in the safe position will not propagate to other ignition materials, nor will resultant flame and gases be vented outside the flare device 10. The device includes a rotor assembly that may be readily adjusted from the safe to the arm position by the use of a simple screw driver and is characterized in that an axial force on the rotor is required as well as a rotational force thereby preventing inadvertent arming due to shock or vibration.

We claim:

1. A flare manual safety device comprising:

a housing, a rotor within said housing having at least two positions and having a plurality of passageways therein, a primer within said housing, pyrotechnic material within said housing, said housing having first, second and third port means therein with said primer, said first and second port means and said pyrotechnic material being in alignment but physically separated by said rotor whereby rotation of said rotor to one of said positions to align one of said (passages) passageways with said first and second port means permits ignition of said pyrotechnic material upon ignition of said primer, and rotation of said rotor to another one of said positions to misalign said one passageway prevents accidental or inadvertent ignition of said primer from igniting said pyrotechnic material, another passageway in said rotor and said third port means in said housing being operative with said rotor in said another position to vent said primer upon accidental or inadvertent ignition thereof, wherein said one passageway in said rotor comprises a diametrically positioned hole, said another passageway comprises a chordal slot in said rotor, and said third port means in said housing comprises holes in said housing parallel to said first port means that are in communication with said chordal slot with said rotor in said another position.

2. A flare manual safety device as specified in claim 1 further including sealing means to seal said rotor in said housing.

3. A flare manual safety device as specified in claim 2 wherein said rotor has a normal axial position in said housing but is shiftable therefrom and further including locking means for retaining said rotor in said one position or said another position, said locking means preventing rotation of said rotor unless said rotor is first shifted axially from said normal axial position.

4. A flare manual safety device as specified in claim 3 wherein said rotor includes a screw driver slot for facilitating rotational adjustment thereof, wherein said housing further includes orienting slots, and wherein said locking means comprises a roll pin operatively associated with said rotor, said roll pin normally engaging said orienting slots to prevent rotation of said rotor but being moved out of engagement with said orienting slots to allow rotor rotation when said rotor is axially shifted from said normal position.

5. A flare manual safety device as specified in claim 4 further including indication means on said housing to indicate whether the rotor is in the safe or the arm position, said screw driver slot and said roll pin both printing to either the "SAFE" or the "ARM" indications on the housing to indicate the condition of the safety device.

* * * * *